US007950526B2

(12) United States Patent
Mätzig

(10) Patent No.: US 7,950,526 B2
(45) Date of Patent: May 31, 2011

(54) DEVICE AND METHOD FOR CARRYING OUT A FINANCIAL IN-PAYMENT TRANSACTION

(75) Inventor: Christoph Mätzig, Ampfing (DE)

(73) Assignee: Giesecke & Devrient GmbH, Munich (DE)

( * ) Notice: Subject to any disclaimer, the term of this patent is extended or adjusted under 35 U.S.C. 154(b) by 254 days.

(21) Appl. No.: 10/550,494

(22) PCT Filed: Jan. 29, 2004

(86) PCT No.: PCT/EP2004/000801

§ 371 (c)(1),
(2), (4) Date: Jun. 30, 2006

(87) PCT Pub. No.: WO2004/088600

PCT Pub. Date: Oct. 14, 2004

(65) Prior Publication Data

US 2007/0007102 A1 Jan. 11, 2007

(30) Foreign Application Priority Data

Apr. 4, 2003 (DE) ..... 103 15 445

(51) Int. Cl.
*B07C 5/00* (2006.01)

(52) U.S. Cl. ..... 209/534; 194/206; 194/207; 902/12; 902/13

(58) Field of Classification Search ..... 209/534; 194/206, 207; 902/12, 13, 17
See application file for complete search history.

(56) References Cited

U.S. PATENT DOCUMENTS

| | | | | |
|---|---|---|---|---|
| 4,596,924 | A * | 6/1986 | Watanabe | 235/379 |
| 4,744,468 | A | 5/1988 | Goi et al. | |
| 4,854,452 | A | 8/1989 | Uchida et al. | |
| 4,889,220 | A * | 12/1989 | Yoshinori et al. | 194/206 |
| 5,943,631 | A * | 8/1999 | Kayani | 702/34 |
| 6,128,402 | A * | 10/2000 | Jones et al. | 382/135 |
| 2003/0038063 | A1 | 2/2003 | Takahashi | |

FOREIGN PATENT DOCUMENTS

| | | | |
|---|---|---|---|
| DE | 37 36 263 | A1 | 5/1988 |
| EP | 0 317 537 | A2 | 5/1989 |
| EP | 0 734 001 | A2 | 9/1996 |
| EP | 0 811 208 | B1 | 12/1997 |
| GB | 2 109 974 | A | 6/1983 |
| WO | 02/50784 | A2 | 6/2002 |

* cited by examiner

*Primary Examiner* — Joseph C Rodriguez
(74) *Attorney, Agent, or Firm* — Bacon & Thomas PLLC

(57) ABSTRACT

An apparatus and a method for executing a money deposit transaction. During a money deposit transaction the state of the bank notes to be deposited is ascertained, bank notes being in a good state are made available to the depositor after the completion of the money deposit transaction, while bank notes being in an unsatisfactory state are withheld.

13 Claims, 1 Drawing Sheet

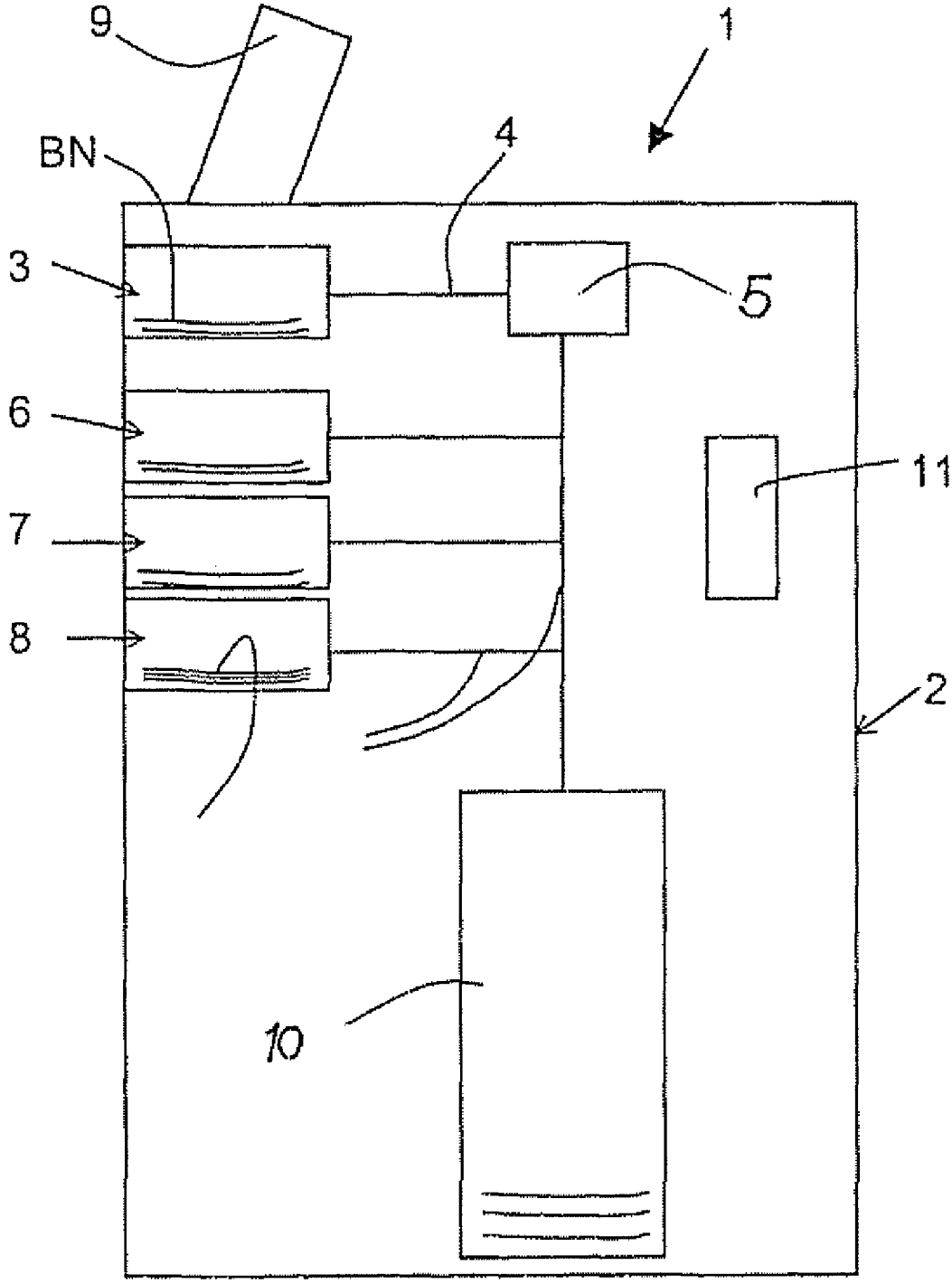
9
1
BN
4
3
5
6
11
7
8
2
10

DEVICE AND METHOD FOR CARRYING OUT A FINANCIAL IN-PAYMENT TRANSACTION

BACKGROUND OF THE INVENTION

A. Field

The invention relates to an apparatus and a method for executing a money deposit transaction.

B. Related Art

Such systems are known in a wide variety. EP 0 811208 B1, for example, describes a money depositing apparatus, in which bank notes are inserted in bundles, isolated, checked, the accepted bank notes are supplied to an intermediate storage device not accessible for the operator during the ongoing transaction and the not accepted bank notes are supplied to a freely accessible return pocket. If the operator agrees to the final storage of the accepted bank notes, these bank notes are transferred from the intermediate storage device into a bank note cassette and are finally stored therein protected against an unauthorized access by the operator.

Such apparatuses, for example, serve for a depositor, e.g. a retailer, being able to deposit his daily receipts of cash money without the aid of bank clerks and the automatically determined nominal value of the inserted bank notes being credited to a bank account of the depositor.

Usually the bank notes deposited in such money depositing apparatus are checked by sensors, for example, as to currency, denomination, authenticity, state etc. Bank notes, the assessment of which is problematic, are returned into the freely accessible return pocket to the depositor. All other bank notes, in particular recognized authentic bank notes being in a good state are accepted and finally stored in the bank note cassette.

However, after having completed the deposition of e.g. his daily receipts, the depositor often wishes to receive a certain amount of bank notes, that he needs e.g. as change for the next day.

For dispensing change, however, a greater effort is required, since beside the apparatus for accepting bank notes a further apparatus for dispensing bank notes has to be provided, or the apparatus for accepting bank notes has to be extended in such a way, that already withheld bank notes can again be dispensed.

Therefore it is the problem of the present invention to provide an apparatus and a method for executing a money deposit transaction, which permit that after the completion of the money deposit transaction with a minimum of effort a certain amount of bank notes is made available to a depositor.

SUMMARY OF THE INVENTION

The invention is based on the thought, that with a money deposit transaction the state of the bank notes to be deposited is determined, the bank notes being in a good state (i.e., fitness) are made available to the depositor after the completion of the money deposit transaction, while bank notes being in an unsatisfactory state (unfit for circulation) are withheld.

For example, all the bank notes inserted during an ongoing money deposit transaction, which are in a desired, good state, are dispensed to the depositor. Bank notes having a different, worse state are finally stored in the apparatus. I.e. in one single operation during the money deposit transaction bank notes fit for circulation are dispensed to the depositor, whereas bank notes unfit for circulation are withheld in the apparatus, a redispensing of the bank notes no longer fit for circulation not being provided.

DESCRIPTION OF THE DRAWING

Further advantages of the present invention are explained and described in detail in the following with reference to the drawing attached.

The only FIGURE shows a schematic view of the substantial components of an apparatus 1 for executing a money deposit transaction according to an embodiment of the present invention.

DETAILED DESCRIPTION OF THE PREFERRED EMBODIMENTS OF THE INVENTION

The apparatus 1 for executing a money deposit transaction has a housing 2. In the housing 2 is integrated an input pocket 3 freely accessible from outside, into which the operator, i.e. the depositor, can insert bank notes BN, which are to be withheld by the apparatus 1 and e.g. credited to a bank account of the operator. By means of a transport system 4, which may have basically known singling and transportation means, the bank notes BN inserted as bundles into the pocket 3 are transported separately through a checking device 5, in which they are checked as to certain physical and/or chemical properties. The checking device 5 beside checking currency, denomination and authenticity of the inserted bank notes in particular serves for determining the state (i.e., fitness) of the inserted bank notes BN. This means, that in the checking device 5 it is checked e.g. whether inserted and received bank notes BN are worn, soiled, damaged or changed in any other fashion, which would oppose a further use of the bank notes BN in the money circulation.

In dependence on the result of the checking, the bank notes BN during a first portion of the ongoing money deposit transaction then are supplied to one of three possible storage pockets 6 to 8. The first storage pocket 6 is a pocket freely accessible from outside, into which the rejected bank notes not accepted by the checking device 5 are dispensed. These can be, for example, bank notes, which are not recognized by the checking device 5, for example because they are of a currency, the acceptance of which is not provided. Into the second storage pocket 7, which also is freely accessible from outside for the operator, all those bank notes BN are dispensed, which were recognized to be authentic by the checking device 5, and the state of which or fitness for circulation is so good, that the bank notes BN are suitable for further circulating in the money circulation. This can mean, for example, that all those bank notes are dispensed into the storage pocket 7, which the checking device 5 recognizes to be only little soiled and/or little worn and/or little damaged. All other bank notes BN, which the checking device 5 accepts to be authentic, including banknotes determined to be unfit for circulation, are transported into the third storage pocket 8, which serves as intermediate storage device. The storage pocket 8 during an ongoing money deposit transaction is closed, e.g. by a not shown, automatically lockable flap, in such a way that the operator does not have access to the bank notes BN located in the storage pocket 8.

After the processing of the bank notes BN, which the operator has inserted into the input pocket 3 during the first portion of the ongoing money deposit transaction, the operator has at his disposal all those bank notes of the deposit transaction, the state of which is so good, that they are suitable for further circulating in the circulation of money.

After all the bank notes inserted into the input pocket 3 have been checked and distributed into the three storage pockets 6 to 8 in the above-described fashion, the operator by means of a display and input unit 9 is requested, for example by displaying a respective text or the flashing up of a pertinent symbol in the form of a pictograph, to complete the money deposit transaction. The display and input unit 9 may also display, how many bank notes fit for circulation are located in the storage pocket 7, how many bank notes are located in the intermediate storage device 8 and how many bank notes possibly are located in the reject pocket 6. Additionally, further data such as currency, denomination and amount of bank notes in the storage pockets 7 and 8 may be displayed.

When the operator via the display and input unit 9 confirms that the deposited bank notes are to be finally withheld in the apparatus 1, during a second portion of the ongoing money deposit transaction the bank notes located in the storage pocket 8, that serves as an intermediate storage device, will be transported into a bank note cassette 10 integrated in the housing 2, which likewise is not accessible from outside for the user. The bank note cassette 10 usually is mounted in the housing to be replaceable. For completing the ongoing transaction the deposit data are passed on to a central bank office for the purpose of crediting the deposited amount to an account determined by the operator.

The above-described components of the apparatus 1 are actuated by means of a control unit 11 via not shown signal lines. The control unit 11 in particular also regulates the diversion of the bank notes BN into the respective storage pockets 6 to 8 or the transportation from the storage pocket 8 serving as intermediate storage device into the bank note cassette 10.

When the operator, however, wishes to interrupt an ongoing money deposit transaction and does not wish the bank notes BN located in the storage pocket 8 being finally stored in the bank note cassette 10, during the second portion of the money deposit transaction he can cancel the individual operation by means of the display and input unit 9. In this case after the completion of the first portion of the transaction the flap of the storage pocket 8 is automatically actuated, unlocked and opened, so that the operator has free access to the bank notes BN stored therein. Alternatively, it is also possible, that the storage pocket 8 in no case is accessible for the operator, and therefore the bank notes in case of a cancellation of the transaction are transferred into one of the two freely accessible storage pockets 6, 7 or the input pocket 3 via respective transport means.

Beside the described proceeding, with which all bank notes fit for circulation, i.e. all bank notes being in a good state, are returned to the operator, proceedings differing from this described proceeding are possible.

It can be provided, that the operator by means of the display and input unit 9 determines certain criteria for the dispensing of the bank notes. For example, the operator can specify a certain amount, which e.g. is needed as change in a cash desk or which has originally been there as change. In this case bank notes fit for circulation are transported into the storage pocket 7 until the specified amount is reached. Since it is known, how much change has originally been there, in this way precisely the amount of the receipts e.g. of the last day are transported into the storage pocket 8 and thus into the bank note cassette 10 and therefore are deposited. The rest of the bank notes of the deposit transaction independently of their state are transported into the storage pocket 8. Likewise, there can be provided, that the operator chooses one or more certain currencies and/or denominations. In this case only bank notes fit for circulation of certain currencies and/or denominations are transported into the storage pocket 7. It is further possible, that the operator determines a certain number of bank notes fit for circulation, which are to be transported into the storage pocket 7. The determined number may relate to bank notes of a certain currency and/or denomination, however, the operator can also give a plurality of specifications as to the number of different currencies and/or denominations. It is obvious, that the described criteria and further criteria can be combined as desired, so as to permit a dispensing of bank notes fit for circulation according to the request of the operator.

Alternatively, the operator by means of the display and input unit 9 may specify, how many bank notes of the deposit transaction shall be transported into the storage pocket 8 serving as intermediate storage device and thus into the bank note cassette 10. The operator for this purpose may specify the number of certain bank notes, their currency, denomination etc. The specifications may also relate to a certain total amount, which is to be formed by the banknotes to be transported into the storage pocket 8 and thus into the bank note cassette 10. The total amount may be, for example, the daily receipt of one or more cash desks or cashiers. In this case at first, according to the specifications of the operator, bank notes are transported into the storage pocket 8 and thus into the bank note cassette 10 and thus are deposited, until the specifications, e.g. the total amount, are met. The rest of the bank notes of the deposit transaction or bank notes, which do not meet the specifications, are transported into the accessible storage pocket 7, here it can occur, that bank notes are transported into the storage pocket 7, which were not classified as fit for circulation.

Instead of the operator entering the above-described specifications, it can also be provided that respective specifications are made by the cash desk or cash desks, from which the bank notes to be deposited come from. This can be, for example, the daily receipt determined by the cash desk or the known, originally available amount of change. The specifications may be transmitted from the cash desk to the apparatus 1 via a data line for executing the money deposit transaction. Likewise, it is possible, that respective data are stored on a magnetic stripe card or chip card, that is used by the operator for identifying himself at the apparatus 1 for executing the money deposit transaction.

For determining the state of the bank notes BN, i.e. their fitness for circulation, the checking device 5 can have one or more sensors, which detect e.g. optical soiling (spots, inscription), flaws, tears, dog ears, wear, limpness etc. The data provided by the checking device 5 are evaluated by the checking device 5 itself or by the control unit 11. For this purpose threshold values are predetermined, which when exceeded or undershot indicate a bad or good state of the bank notes and thus their fitness for circulation. In an embodiment it can be provided, that the operator by means of the display and input unit 9 can influence the threshold values, so that the assessment of the fitness for circulation, i.e. the quality of the state, is changeable. It can also be provided, that for the assessment of the fitness for circulation certain quality criteria are predetermined e.g. by a central bank, for example by the European Central Bank, which sets respective standards in Article 6 ECB.

In one variant it is provided, that the bank notes located in the reject pocket 6 are removed from the reject pocket 6 and again are inserted into the input pocket 3 by the operator. Then a reassessment of the bank notes in the above-described fashion is effected, since bank notes not recognized during the first assessment often can be recognized with a reassessment.

The invention claimed is:

1. A method for executing an ongoing money deposit transaction, in which an operator deposits bank notes in an apparatus for executing the money deposit transaction, according to which ongoing money deposit transaction deposited money is inserted and received in the apparatus during a first portion of the ongoing deposit transaction, and is credited to an account of the operator or may at least in part be returned to the operator during a second portion of the ongoing deposit transaction, comprising the following steps:

inserting the bank notes to be deposited into an input pocket of the apparatus during the first portion of the ongoing deposit transaction, during the first portion of the ongoing deposit transaction, checking the inserted bank notes by a checking device of the apparatus at least as to the authenticity and the state of the bank notes and determining fitness for circulation of said banknotes as a result of the checking, transporting at least parts of the bank notes which were recognized as not fit for circulation by the checking device into a storage pocket of the apparatus not accessible by the operator during the first portion of the ongoing money deposit transaction, transporting at least parts of the bank notes which were recognized as fit for circulation by the checking device into a storage pocket of the apparatus freely accessible by the operator during the second portion of the ongoing money deposit transaction, subsequently transporting the bank notes located in the not accessible storage pocket into a bank note cassette not accessible by the operator; and crediting the account of the operator for the amount of money deposited by the operator and retained by the apparatus.

2. The method according to claim 1, wherein at the beginning of the money deposit transaction criteria are predetermined for the bank notes that are to be transported into either or both the freely accessible storage pocket and the not accessible storage pocket.

3. The method according to claim 2, wherein the criteria relate to one or more of an amount, a number, a currency, and a denomination of the bank notes.

4. The method according to claim 2, wherein the criteria are predetermined by the operator by means of a display and input unit.

5. The method according to claim 2, wherein the criteria are predetermined by one or more cash desks from which the deposited bank notes have come.

6. The method according to claim 1, wherein criteria used by the checking device for checking the bank notes as to their fitness state are changeable.

7. The method according to claim 1, wherein bank notes not recognized by the checking device are dispensed into another freely accessible storage pocket.

8. An apparatus for executing an ongoing money deposit transaction, namely depositing bank notes during a first portion of the ongoing money deposit transaction and selectively returning at least some deposited money to an operator or transporting at least some of the deposited money to a bank note cassette not accessible to the operator during a second portion of the ongoing money deposit transaction, comprising:

an input pocket accessible to an operator during the ongoing money deposit transaction, arranged to enable the operator to insert bank notes to be deposited by the operator during the first portion of the ongoing money deposit transaction, a checking device arranged to check bank notes inserted into the input pocket at least as to the authenticity and state of the bank notes and to determine fitness for circulation of said banknotes during the first portion of the ongoing money deposit transaction, a storage pocket not accessible to the operator during the ongoing money deposit transaction, a storage pocket freely accessible to the operator during the ongoing money deposit transaction, a bank note cassette not accessible to the operator, and a transport system arranged to transport the bank notes from the input pocket to the checking device, from the checking device to the freely accessible storage pocket and to the not accessible storage pocket during the first portion of the ongoing money deposit transaction, and from the not accessible storage pocket into the bank note cassette during the second portion of the ongoing money deposit transaction, and a control unit arranged to actuate the transport system in such a way that bank notes not fit for circulation at least partially are transported into the not accessible storage pocket during the first portion of the ongoing money deposit transaction, and bank notes fit for circulation at least partially are transported into the freely accessible storage pocket during the first portion of the ongoing money deposit transaction for selective return or partial return to the operator during the second portion of the ongoing money deposit transaction.

9. The apparatus according to claim 8, including a display and input unit for the input of criteria for the transportation of the bank notes either or both fit for circulation and not fit for circulation into either or both the freely accessible storage pocket and the not accessible storage pocket.

10. The apparatus according to claim 8, wherein the apparatus is connected with at least one cash desk providing criteria for either or both the transportation of the bank notes fit for circulation and not fit for circulation into either or both the freely accessible storage pocket and the not accessible storage pocket.

11. The apparatus according to claim 9, wherein the criteria relate to one or more of an amount, a number, a currency and a denomination of the bank notes.

12. The apparatus according to claim 8, wherein the criteria used by the checking device for checking the bank notes as to their fitness state are changeable.

13. The apparatus according to claim 8, including another storage pocket freely accessible to the operator during the ongoing money deposit transaction, and wherein the transport system is arranged to transport bank notes not recognized by the checking device, under the control of the control unit, into said another freely accessible storage pocket.

* * * * *